US011149949B2

(12) United States Patent
Fox et al.

(10) Patent No.: US 11,149,949 B2
(45) Date of Patent: Oct. 19, 2021

(54) CONVERGING DUCT WITH ELONGATED AND HEXAGONAL COOLING FEATURES

(71) Applicant: Siemens Aktiengesellschaft, Munich (DE)

(72) Inventors: Timothy A. Fox, Simcoe (CA); Jacob William Hardes, Vancouver (CA)

(73) Assignee: Siemens Energy Global GmbH & Co. KG, Munich (DE)

( * ) Notice: Subject to any disclaimer, the term of this patent is extended or adjusted under 35 U.S.C. 154(b) by 149 days.

(21) Appl. No.: 16/304,497

(22) PCT Filed: Jul. 25, 2016

(86) PCT No.: PCT/US2016/043809

§ 371 (c)(1),
(2) Date: Nov. 26, 2018

(87) PCT Pub. No.: WO2018/021993

PCT Pub. Date: Feb. 1, 2018

(65) Prior Publication Data

US 2019/0293291 A1 Sep. 26, 2019

(51) Int. Cl.
*F01D 9/02* (2006.01)
*F23R 3/06* (2006.01)

(52) U.S. Cl.
CPC ..... *F23R 3/06* (2013.01); *F01D 9/023* (2013.01); *F05D 2220/32* (2013.01); *F05D 2250/70* (2013.01); *F05D 2260/20* (2013.01); *F05D 2260/203* (2013.01); *F23R 2900/03041* (2013.01)

(58) Field of Classification Search
CPC ..... F23R 3/06; F23R 3/002; F23R 2900/03041–03044; F01D 9/023; F05D 2260/202
See application file for complete search history.

(56) References Cited

U.S. PATENT DOCUMENTS 5,737,922 A * 4/1998 Schoenman ..... F23R 3/005 60/752
5,775,589 A 7/1998 Vdoviak et al.
(Continued)

FOREIGN PATENT DOCUMENTS

EP 1207273 A2 5/2002
EP 1426558 A2 6/2004
EP 2960436 A1 12/2015

OTHER PUBLICATIONS

PCT International Search Report and Written Opinion dated Feb. 28, 2017 corresponding to PCT Application No. PCT/US2016/043809 filed Jul. 25, 2016.

*Primary Examiner* — Todd E Manahan
*Assistant Examiner* — Todd N Jordan

(57) ABSTRACT

A gas turbine engine has a converging duct that has combustion products flow at low mach speeds through a first portion and a high mach speeds through a second portion. The converging duct has two types of cooling schemes formed. One type of cooling scheme is beneficial for the low mach speed combustion product flow and one type of cooling scheme is beneficial for the high mach speed combustion product flow. The two cooling schemes are blended together in order increase the efficiency of the cooling of the converging duct.

16 Claims, 4 Drawing Sheets

(56) References Cited

U.S. PATENT DOCUMENTS

| | | | | |
|---|---|---|---|---|
| 6,955,053 | B1 * | 10/2005 | Chen | F23R 3/06 60/752 |
| 9,840,924 | B2 * | 12/2017 | Hase | F23R 3/005 |
| 9,957,816 | B2 * | 5/2018 | Bunker | F02C 7/18 |
| 10,532,429 | B2 * | 1/2020 | Bunel | B26F 1/26 |
| 10,627,110 | B2 * | 4/2020 | Shibata | F01D 25/12 |
| 2006/0053798 | A1 | 3/2006 | Hadder | |
| 2010/0071382 | A1 | 3/2010 | Liang | |
| 2010/0162716 | A1 | 7/2010 | Bastnagel et al. | |
| 2015/0377134 | A1 * | 12/2015 | Maurer | F23R 3/005 60/754 |
| 2016/0047312 | A1 * | 2/2016 | Hase | F02C 7/18 60/806 |
| 2017/0292389 | A1 * | 10/2017 | Lorstad | F01D 25/14 |
| 2017/0370235 | A1 * | 12/2017 | Konishi | F02C 3/04 |
| 2018/0038594 | A1 * | 2/2018 | Shibata | F02C 7/18 |

* cited by examiner

CONVERGING DUCT WITH ELONGATED AND HEXAGONAL COOLING FEATURES

BACKGROUND

1. Field

Disclosed embodiments are generally related to gas turbine engines and, more particularly to gas turbine engines producing low and high mach combustion products.

2. Description of the Related Art

Gas turbine engines comprise a casing or cylinder for housing a compressor section, a combustion section, and a turbine section. A supply of air is compressed in the compressor section and directed into the combustion section. The compressed air enters the combustion inlet and is mixed with fuel. The air/fuel mixture is then combusted to produce high temperature and high pressure gas. This working gas then travels past the combustor transition and into the turbine section of the turbine.

Generally, the turbine section comprises rows of vanes which direct the working gas to airfoil portions of the turbine blades. The working gas travels through the turbine section, causing the turbine blades to rotate, thereby turning the rotor. The rotor is attached to the compressor section, thereby turning the compressor and also an electrical generator for producing electricity. A high efficiency of a combustion turbine is achieved by heating the gas flowing through the combustion section to as high a temperature as is practical. The hot gas, however, may degrade the various metal turbine components, such as the combustor, transition ducts, vanes, ring segments and turbine blades that it passes when flowing through the turbine.

For this reason, strategies have been developed to protect turbine components from extreme temperatures such as the development of cooling features on components. Providing heat management features to improve the efficiency and life span of components and the gas turbine engines is further needed. Of course, the cooling features described herein are not limited to use in context of gas turbine engines, but are also applicable to other heat impacted devices, structures or environments.

SUMMARY

Briefly described, aspects of the present disclosure relate to cooling features in gas turbine engines.

An aspect of the disclosure may be a gas turbine engine comprising a combustor; a converging duct connected to the combustor, wherein the converging duct comprises; a first portion having a first portion layer, wherein the first portion has a first diameter, wherein the first portion layer has formed thereon cooling channels for cooling the first portion, wherein the cooling channels extend axially from upstream to downstream; a second portion having a second portion layer, wherein the second portion has a second diameter smaller than the first diameter, wherein the second portion layer has formed thereon high mach cooling features for cooling the second portion; and wherein effusion holes are formed in the cooling channels at a location proximate to the second portion layer.

Another aspect of the present disclosure may be a converging duct comprising a first portion having a first portion layer, wherein the first portion has a first diameter, wherein the first portion layer has formed thereon cooling channels for cooling the first portion, wherein the cooling channels extend axially from upstream to downstream; a second portion having a second portion layer, wherein the second portion has a second diameter smaller than the first diameter, wherein the second portion layer has formed thereon high mach cooling features for cooling the second portion; and wherein effusion holes are formed in the cooling channels at a location proximate to the second portion layer.

DETAILED DESCRIPTION

To facilitate an understanding of embodiments, principles, and features of the present disclosure, they are explained hereinafter with reference to implementation in illustrative embodiments. Embodiments of the present disclosure, however, are not limited to use in the described systems or methods.

The components and materials described hereinafter as making up the various embodiments are intended to be illustrative and not restrictive. Many suitable components and materials that would perform the same or a similar function as the materials described herein are intended to be embraced within the scope of embodiments of the present disclosure.

Figure 1:
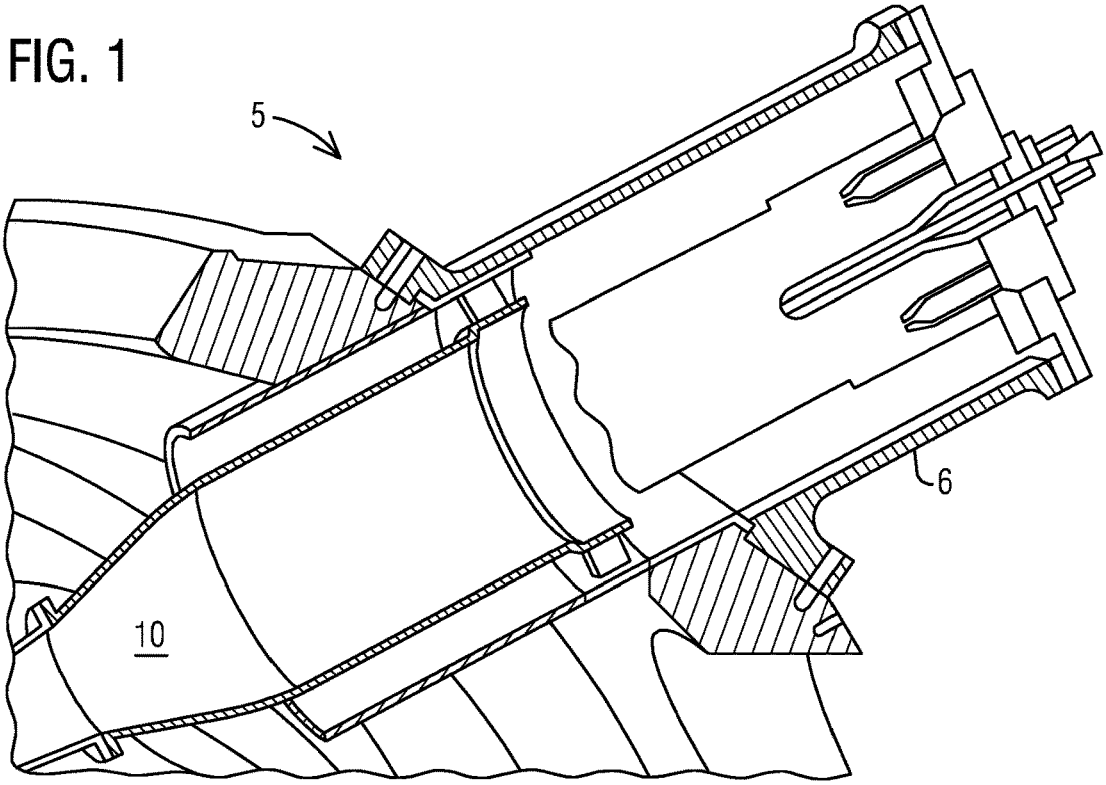
FIG. 1 shows a view of the converging duct in a gas turbine engine.

In order to accelerate the combustion products to a high mach speed, a gas turbine engine may employ a converging duct. FIG. 1 shows a converging duct 10 located within a gas turbine engine 5. The converging duct is located downstream of a combustor 6. The combustor 6 produces combustions products that move downstream through the converging duct 10 in an axial direction. As the combustion products move downstream through the converging duct 10 they move from a low mach speed to a high mach speed in some instances.

Combustion products will flow through the converging duct 10 at speeds between 0.2 to 0.85 mach. Low mach speed is when the flow speed of the combustion products is between 0.2 to 0.45 mach. High mach speed is when the flow speed of the combustion products is between 0.45 to 0.7 mach. It should be understood that flows speeds between 0.4-0.5 mach could be considered either low mach speed or high mach speed.

Figure 2:
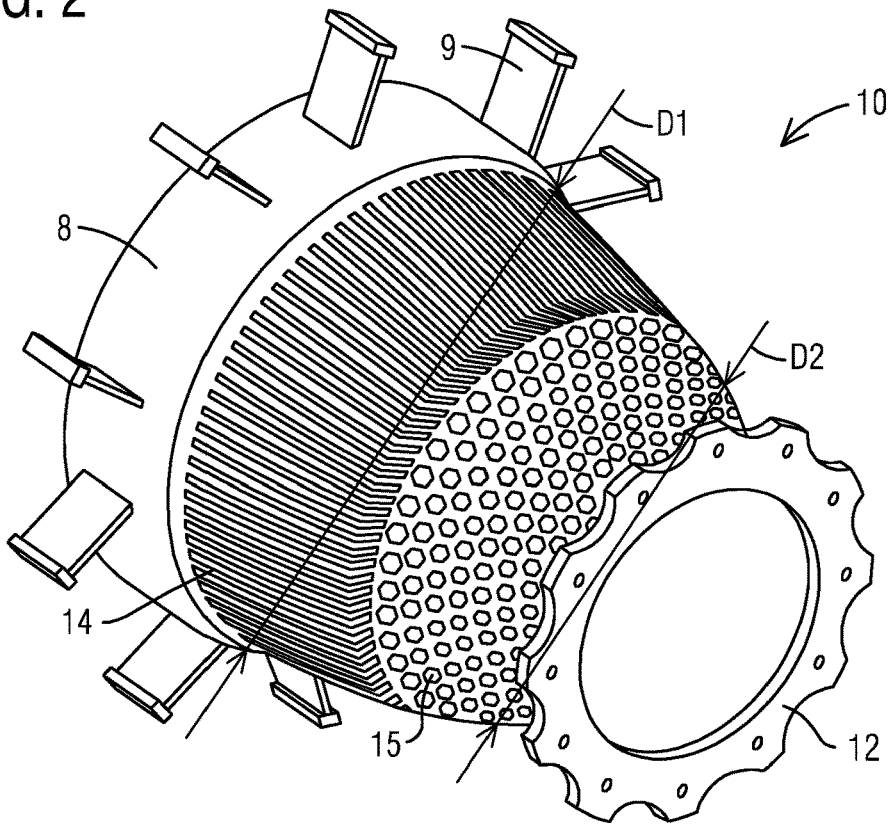
FIG. 2 is a view of the converging duct.

A converging duct 10, made in accordance with an embodiment of the present disclosure, is shown in FIG. 2. The converging duct 10 needs to be cooled in order to maintain the durability of the component and to increase the life span of the converging duct 10. The passage of the combustion products through the converging duct go from the low mach range to the high mach range. The transition of the flow speed of the combustion productions from low mach to high mach speeds complicates the way in which cooling features are employed in the converging duct 10. Some cooling schemes are not effective for flows that are in the high mach range and some cooling schemes would waste air if cooling structures in regions subject to low mach speed flows. This occurs due to an increasing pressure drop across cooling schemes associated with higher mach flows.

In order to fully take advantage of the different mach ranges of combustion products passing through the converging duct 10 a blended combination of effective cooling schemes for the low mach and the high mach ranges are employed in order to reduce the consumption of cooling air in the converging duct 10.

The cooling scheme shown in FIG. 1 may be able to reduce consumption of cooling air by the converging duct 10 by up to 50%. By employing bonded panel technology this can be accomplished. Bonded panel technology is when layers can be bonded together to form a component. This permits more complicated geometries to be formed than when a component is cast as a single piece. The bonded panel technology employed in forming the converging duct 10 enables multiple cooling features to be employed by using a single bonded sheet to form both the low speed and high speed mach cooling features and then bonding these sheets to form additional layers of the component.

While bonded panel technology is discussed herein in forming the converging duct 10, it should be understood that other techniques may be employed as well, such as casting, welding and brazing pieces together. However, the resulting products may not have the same structural integrity as when bonded panel technology is employed.

FIG. 2 shows a view of a converging duct 10 made in accordance with an embodiment of the present disclosure. Connected to the converging duct 10 is an inlet ring 8 having support struts 9. The inlet ring 8 is connected to a combustor 6 which is located upstream from the converging duct 10. Located at the opposite end of the converging duct 10 is an outlet ring 12. The outlet ring 12 is connected to an inlet extension piece (IEP). It should be understood that the outlet ring 12 and IEP may be unitary piece. It should further be understood that while a converging duct 10 is shown and described herein it is possible to implement aspects of the present invention in other components of the gas turbine engine 5 in which there low mach and high mach combustion products flowing through them.

The converging duct 10 may be made of a metal material and has a first portion 14 and second portion 15. The first portion 14 forms the shape of a conical section and has combustion products flow through it at low mach speeds. As the combustion products flow through the first portion 14 their speeds increase. The diameter D1 of the first portion 14 at the location of the inlet ring 8 is substantially the same as the inlet ring 8. The diameter D1 of the converging duct 10 decreases as it extends downstream from the inlet ring 8 to the second portion 15.

The second portion 15 has a diameter D2 that is less than the diameter D1 of the first portion 14. The diameter D2 also decreases as the second portion 15 extends downstream to the outlet ring 12. Combustion products flow at high mach speeds through the second portion 15. The combustion products increase in speed as they flow through the converging duct 10.

Figure 3:
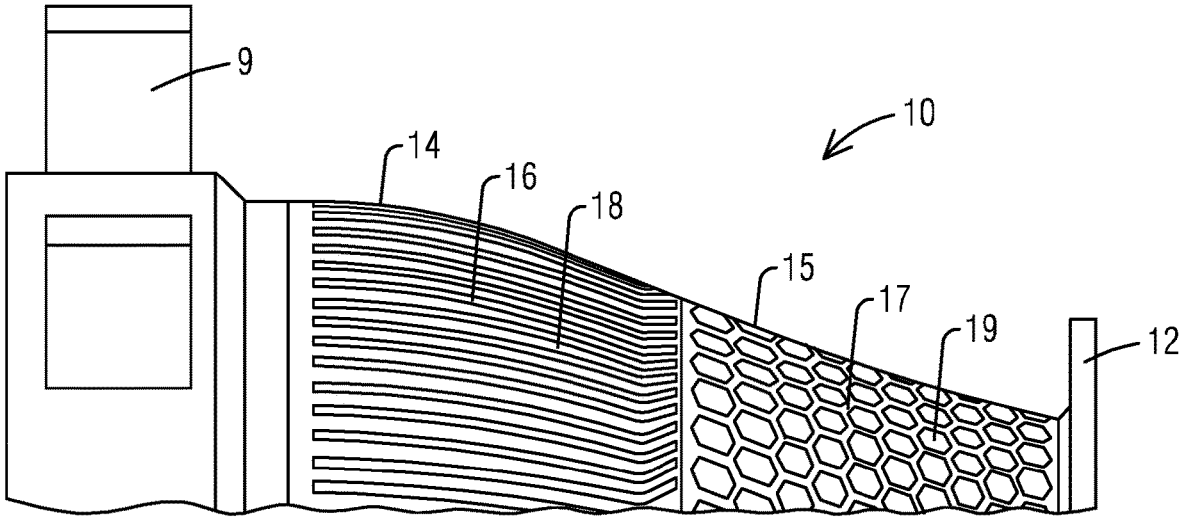
FIG. 3 is a side sectional view of the converging duct shown in FIG. 2.

Referring to FIG. 3, first portion 14 has a first portion layer 16. In the embodiment shown, the first portion layer 16 forms one of the bonded layers used in forming the converging duct 10. The second portion 15 has a second portion layer 17, which forms one of the bonded layers used in forming the converging duct 10. In particular both the first portion layer 16 and the second portion layer 17 may be formed as a single bonded layer. In particular the first portion layer 16 and the second portion layer 17 form the middle bonded layer 23 of the three bonded layers used in forming the converging duct 10, these layers are the top bonded layer 22, middle bonded layer 23 and bottom bonded layer 24, shown in FIGS. 4 and 5.

Formed in the first portion layer 16 are a plurality cooling channels 18. The cooling channels 18 extend in an axial direction downstream from the location where the first portion 14 is connected to the inlet ring 8 to the location where the first portion 14 meets the second portion 15. The cooling channels 18 extend axially down the first portion 18 without intersecting any of the other cooling channels 18. The cooling channels 18 may extend over 50% of the axial length of the converging duct 10.

Each of the cooling channels 18 may have the same width. The conical shape of the converging duct 10 and the first portion 14 on which the cooling channels 18 extend leads to a reduction in pitch between each of the cooling channels 18 as they extend axially downstream. This can best be seen in FIG. 6 where the width W1 between two cooling channels 18 is greater than a width W2 between the same two cooling channels 18 at a location further downstream of the converging duct 10. The reduction in pitch between two cooling channels 18 offsets the increase in coolant temperature and increase in hot side transfer that occurs as it flows through the cooling channels 18. At the location where the coolant is no longer providing a significant cooling benefit to the first portion 14 the coolant will be expelled. The expelled coolant will still be able to provide film cooling of the converging duct 10.

Additional modifications may be made to the cooling channels 18 in order to further increase heat transfer. For example, the cooling channels 18 may be formed with jogs, so as to promote pressure loss and heat transfer increase. Cooling channels 18 may also be formed that have additional circumferential components. Additionally, zig-zags may be incorporated into the cooling channels 18.

Figure 4:
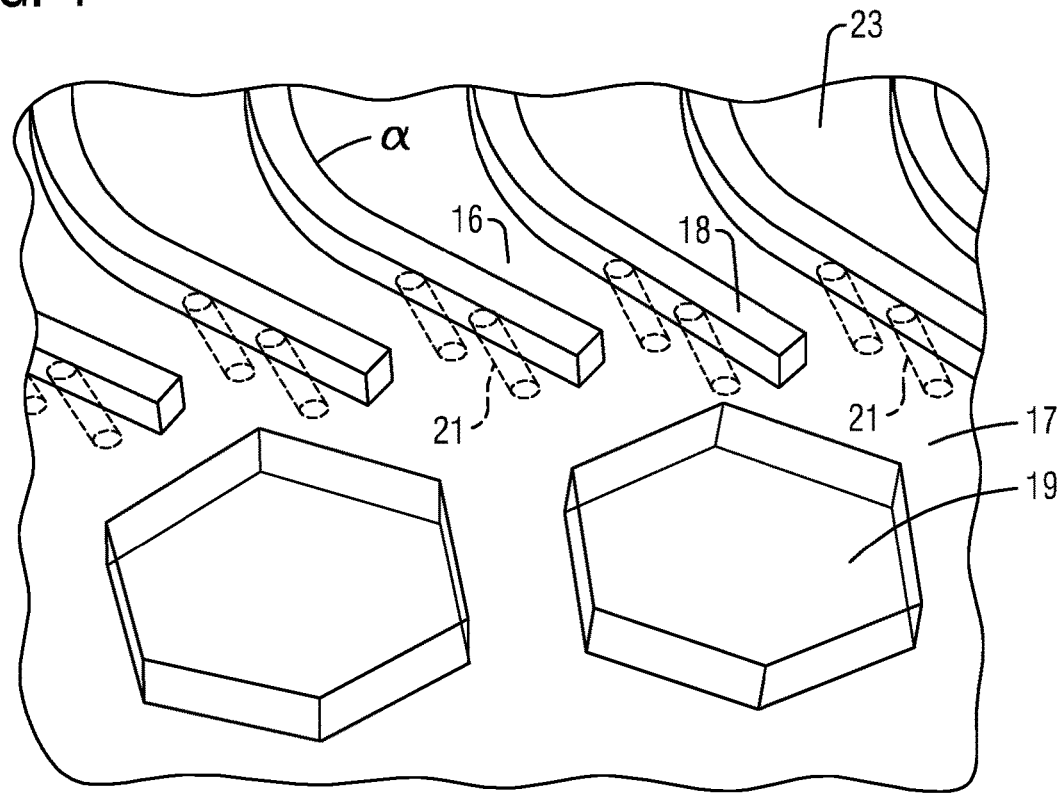
FIG. 4 is a close up view of the surface of the converging duct showing where the cooling features for the first portion of the converging duct terminate.

In FIG. 4, a close up view of the area where the cooling channels 18 approach the second portion layer 17 and the high mach cooling features 19 is shown. As the cooling channels 18 approach the second portion layers 17 they may begin to curve in the circumferential direction. The curvature of the cooling channels 18 is represented by the angle $\alpha$. The angle $\alpha$ may be between 30° and 45°. The formed angle helps in controlling the film cooling of the converging duct 10.

Additionally formed at the distal end of the cooling channels 18 in FIG. 4 may be a plurality of effusion holes 21. The effusion holes 21 are formed at an angle through the bottom bonded layer 24. The formed angle slants in the downstream direction.

Figure 5:
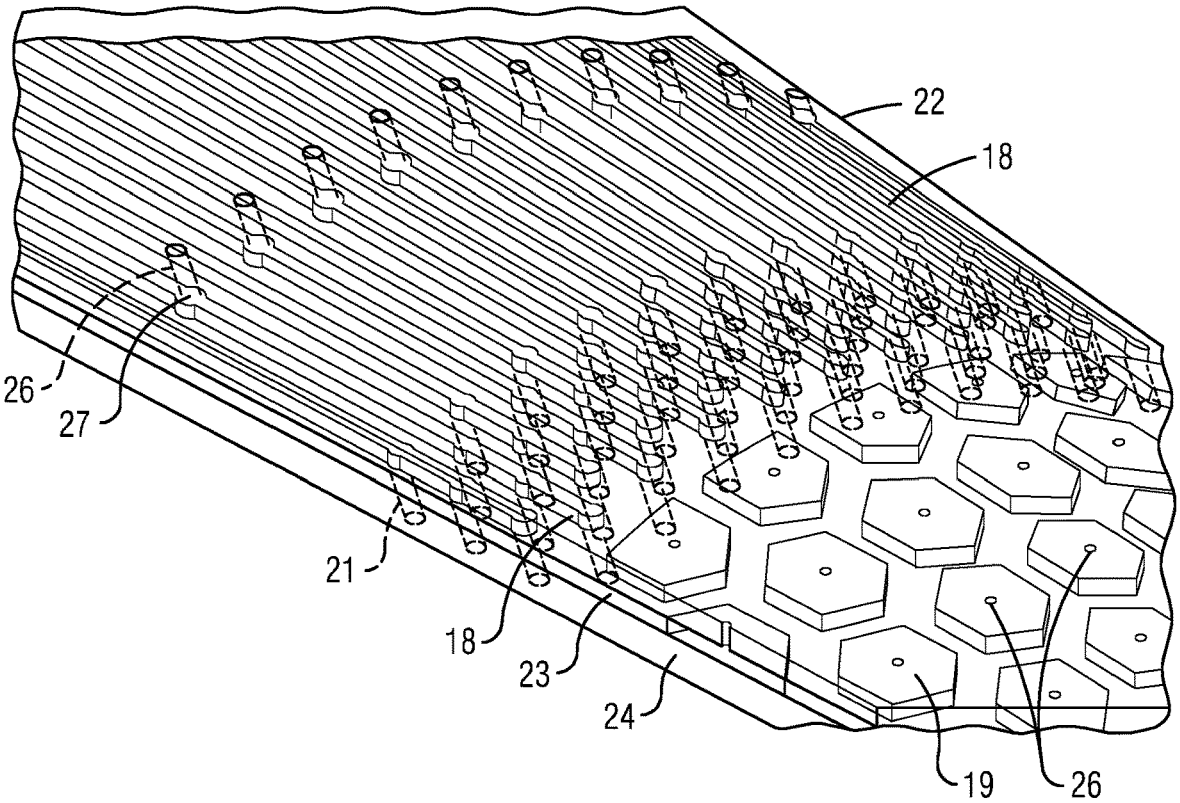
FIG. 5 is a view of the middle bonded layer used in the converging duct.

In the embodiment shown in FIG. 5 the effusion holes 21 may be staggered in the in the location proximate to the second portion 15. By staggered it is meant that the effusion holes 21 in adjacent channels 18 may be located at different positions as one extends along the circumferential direction.

Impingement holes 26 may be formed on the top bonded layer 22 at locations further upstream. The impingement holes 26 are formed so as to expel cooling air into the converging duct 10 prior to entering the second portion 15. These impingement holes 26 allow there to be no film starter rows. This is a benefit in that air consumption in previous film starter rows has been costly in consumption.

As shown in FIG. 5, when impingement holes 26 are used with the channels 18 a reservoir 27 is formed in the layer in which the channels 18 are formed. The impingement holes 26 extend through the top bonded layer 22 at the location of the reservoirs 27.

In the embodiment tshown in FIG. 5, the reservoir 27 may be formed in the middle bonded layer 23. The reservoir 27 is a widening of the channel 18 in middle bonded layer 23. Reservoirs 27 are formed as circles in which the impingement holes 26 or effusion holes 21 may open into. The reservoirs 27 aid in the manufacturing of the converging duct 10 by facilitating the ease with which channels 18 can be connected during construction. The reservoirs 27 also create more area with which to take advantage of cooling air.

As shown in FIG. 5, the high mach cooling features 19 formed in the second portion layer 17 are shown as being hexagonal in shape. However, it should be understood that other shapes may be employed, such as circular, pentagonal, octagonal, etc.

Figure 6:
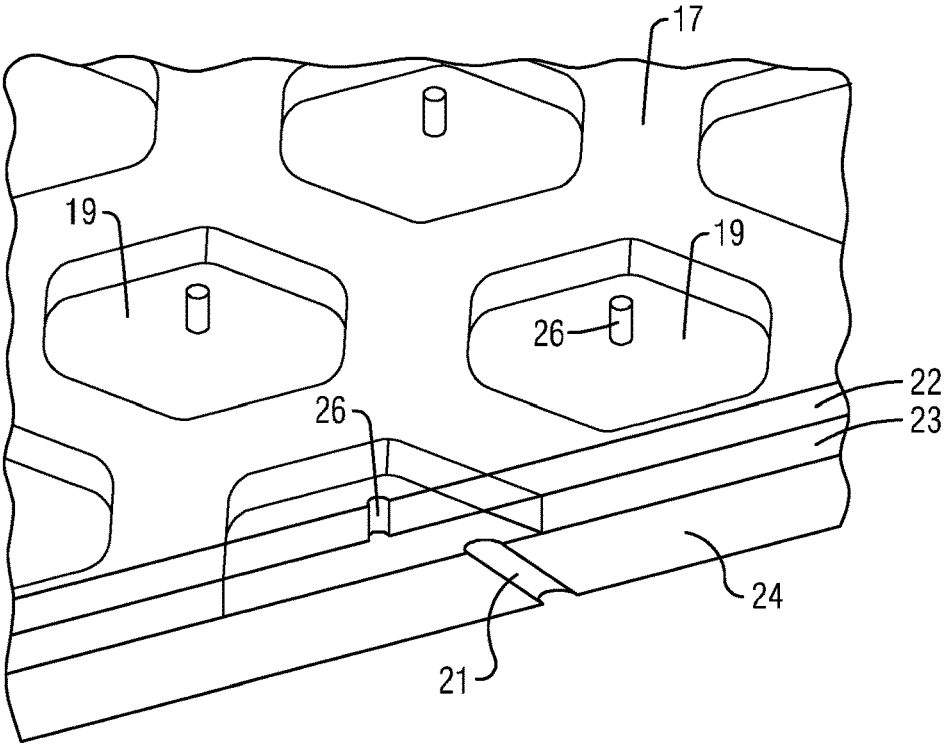
FIG. 6 is a close up view of the cooling features located on the second portion of the converging duct.

FIG. 6 shows a close up view of the high mach cooling features 19 formed in the second portion surface 17. The hexagonal features are formed in the middle bonded layer 23. Also shown are impingement holes 26 and effusion holes 21 which are formed in the top bonded layer 22 and the bottom bonded layer 24, respectively. The effusion hole 21 is angled with and slants in the downstream direction.

Figure 7:
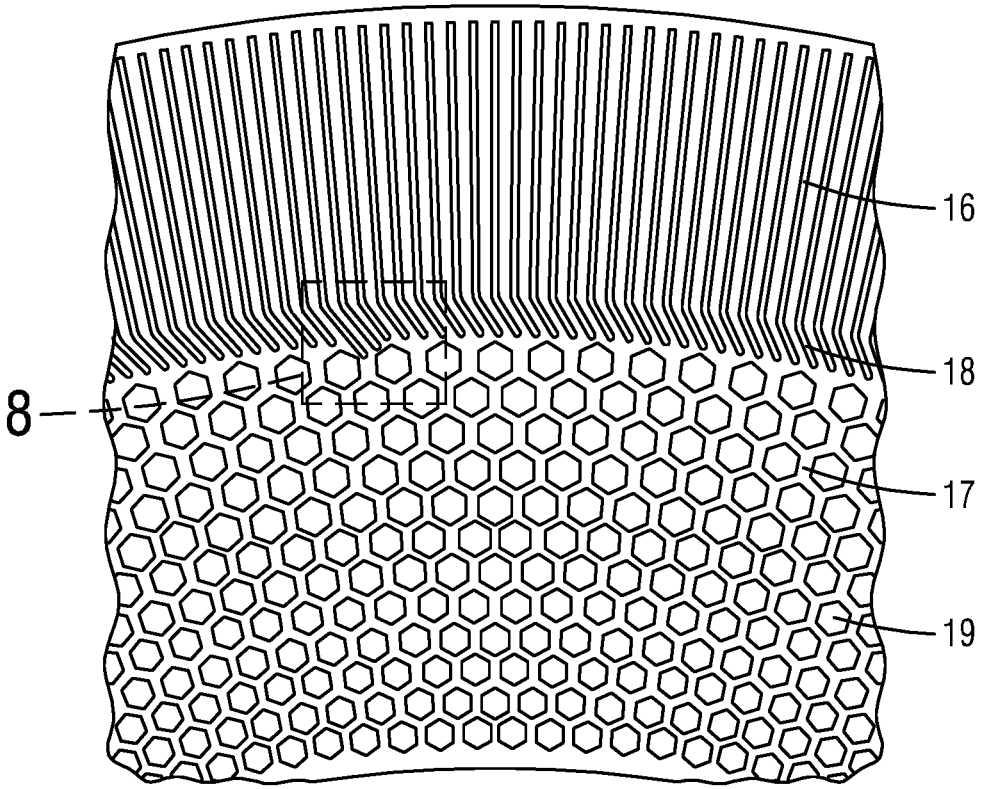
FIG. 7 is a top down view of the cooling features located on the surface of the converging duct.
Figure 8:
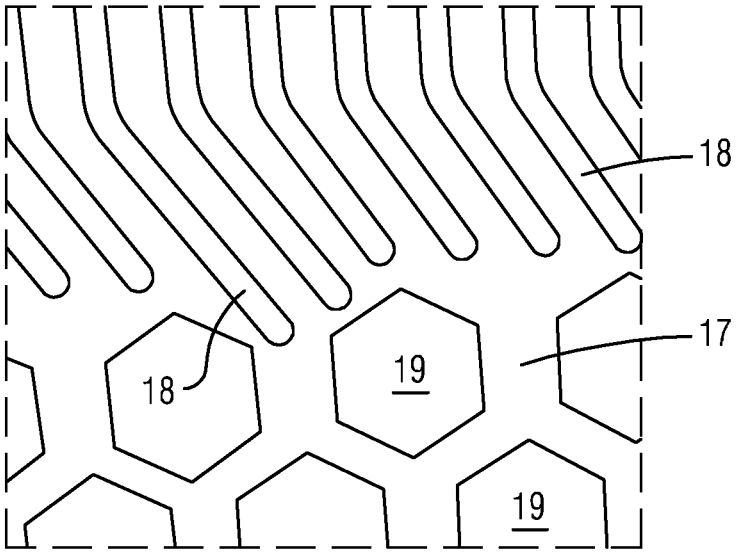
FIG. 8 is a close up top down view of the cooling features located on the surface of the converging duct.

FIGS. 7 and 8 show top down views of the first surface 16 and second surface 17. From this viewpoint it can be seen how the cooling channels 18 can extend into the second surface 19. While the cooling channels 18 extend in the axial direction without intersecting each other, some of the cooling channels 18 extend further into the second surface 17 than other cooling channels 18. The extension of the cooling channels 18 into the second surface 17 maximizes the cooling air that flows over the first portion 14 and the second portion 15, by maximizing the surface area that the cooling features cover. Furthermore, as discussed above, the pitch between the cooling channels decreases as the cooling channels extend downstream in the axial direction.

The high mach cooling features 19 also vary slightly in their nature as they are located further downstream on the converging duct 10. In FIGS. 7 and 8, the dimensions of the hexagons formed decrease as one moves further downstream on the converging duct 10 and as it approaches the outlet ring 12. For instance, the overall size of the hexagon decreases. The decreasing dimensional nature of the hexagonal high mach cooling features 19 permits retention of the spacing between the high mach cooling features 19. Maintaining the spacing of the high mach cooling features 19 permits the cooling features to effectively cool structures in regions subject to the high mach combustion product flow.

While embodiments of the present disclosure have been disclosed in exemplary forms, it will be apparent to those skilled in the art that many modifications, additions, and deletions can be made therein without departing from the spirit and scope of the invention and its equivalents, as set forth in the following claims.

What is claimed is:

1. A gas turbine engine comprising:

a combustor;

a converging duct connected to the combustor, the converging duct comprising a bottom bonded layer, a middle bonded layer, and a top bonded layer, wherein the converging duct is formed by bonding the bottom bonded layer, the middle bonded layer, and the top bonded layer together, wherein the converging duct comprises;

a first portion having a first diameter, wherein the first portion comprises a plurality of cooling channels formed in the middle bonded layer, wherein the plurality of cooling channels extend axially from upstream to downstream, wherein each cooling channel of the plurality of cooling channels comprises an effusion hole and an impingement hole; wherein the effusion hole extends through the bottom bonded layer and extends between its respective cooling channel and an inside of the converging duct, wherein the impingement hole extends through the top bonded layer and extends between its respective cooling channel and an outside of the converging duct; and a second portion downstream of the first portion, the second portion having a second diameter smaller than the first diameter, wherein the second portion comprises a plurality of hexagonal cooling features formed in the middle bonded layer;

wherein each hexagonal cooling feature of the plurality of hexagonal cooling features has a side length greater than the thickness of the middle bonded layer; and wherein each hexagonal cooling feature of the plurality of hexagonal cooling features comprises an effusion hole and an impingement hole; wherein the effusion hole extends through the bottom bonded layer and extends between its respective hexagonal cooling feature and an inside of the converging duct, wherein the impingement hole extends through the top bonded layer and extends between its respective hexagonal cooling feature and an outside of the converging duct.

2. The gas turbine engine of claim 1, wherein the first portion extends axially downstream from the combustor, wherein combustion products flow at first speeds through the first portion.

3. The gas turbine engine of claim 1, wherein combustion products flow at second speeds through the second portion.

4. The gas turbine engine of claim 1, wherein at least one cooling channel of the plurality of the cooling channels extends into the second portion.

5. The gas turbine engine of claim 1, wherein a width between two adjacent cooling channels of the plurality of cooling channels at a first location is greater than a width between the same two cooling channels at a second location, wherein the second location is further downstream than the first location.

6. The gas turbine engine of claim 1, wherein the plurality of cooling channels extend over 50% of the axial length of the converging duct.

7. The gas turbine engine of claim 1, wherein a side length of a first hexagonal cooling feature of the plurality of cooling features at a first location is greater than a side length of a second hexagonal cooling feature of the plurality of cooling features at a second location, wherein the second location is further downstream than the first location.

8. The gas turbine engine of claim 1, wherein at least one of the cooling channels of the plurality of cooling channels curves in a circumferential direction proximate to the second portion.

9. A converging duct comprising:

a bottom bonded layer, a middle bonded layer, and a top bonded layer, wherein the converging duct is formed by bonding the bottom bonded layer, the middle bonded layer, and the top bonded layer together;

a first portion having a first diameter, wherein the first portion comprises a plurality of cooling channels formed in the middle bonded layer, wherein the cooling channels extend axially from upstream to downstream, wherein each cooling channel of the plurality of cooling channels comprises an effusion hole and an impingement hole; wherein the effusion hole extends through the bottom bonded layer and extends between its respective cooling channel and an inside of the converging duct, wherein the impingement hole extends through the top bonded layer and extends between its respective cooling channel and an outside of the converging duct; and a second portion downstream of the first portion, the second portion having a second diameter smaller than the first diameter, wherein the second portion comprises a plurality of hexagonal cooling features formed in the middle bonded layer;

wherein each hexagonal cooling feature of the plurality of hexagonal cooling features has a side length greater than the thickness of the middle bonded layer; and wherein each hexagonal cooling feature of the plurality of hexagonal cooling features comprises an effusion hole and an impingement hole; wherein the effusion hole extends through the bottom bonded layer and extends between its respective hexagonal cooling feature and an inside of the converging duct, wherein the impingement hole extends through the top bonded layer and extends between its respective hexagonal cooling feature and an outside of the converging duct.

10. The converging duct of claim 9, wherein the first portion extends axially downstream and combustion products flow at first speeds through the first portion.

11. The converging duct of claim 9, wherein combustion products flow at second speeds through the second portion.

12. The converging duct of claim 9, wherein at least one cooling channel of the plurality of the cooling channels extends into the second portion.

13. The converging duct of claim 9, wherein a width between two adjacent cooling channels of the plurality of cooling channels at a first location is greater than a width between the same two cooling channels at a second location, wherein the second location is further downstream than the first location.

14. The converging duct of claim 9, wherein the plurality of cooling channels extend over 50% of the axial length of the converging duct.

15. The converging duct of claim 9, wherein a side length of a first hexagonal cooling feature of the plurality of cooling features at a first location is greater than a side length of a second hexagonal cooling feature of the plurality of cooling features at a second location, wherein the second location is further downstream than the first location.

16. The converging duct of claim 9, wherein at least one of the cooling channels of the plurality of cooling channels curves in a circumferential direction proximate to the second portion.

* * * * *